US006792957B2

(12) United States Patent
Choi et al.

(10) Patent No.: US 6,792,957 B2
(45) Date of Patent: Sep. 21, 2004

(54) WET ETCHING APPARATUS AND METHOD

(75) Inventors: Soon Ho Choi, Kyoungsangbuk-do (KR); Jae Hyeob Seo, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 103 days.

(21) Appl. No.: 09/731,738

(22) Filed: Dec. 8, 2000

(65) Prior Publication Data

US 2001/0015210 A1 Aug. 23, 2001

(30) Foreign Application Priority Data

Dec. 11, 1999 (KR) ..... P99-56878

(51) Int. Cl.[7] ..... B08B 3/00
(52) U.S. Cl. ..... 134/61; 134/76; 134/902

(56) References Cited

U.S. PATENT DOCUMENTS 5,763,892 A * 6/1998 Kizaki et al. ..... 250/492.1
5,915,396 A * 6/1999 Kinose ..... 134/61
5,998,766 A * 12/1999 Mizosaki et al. ..... 219/390
6,272,768 B1 * 8/2001 Danese ..... 34/275
6,457,478 B1 * 10/2002 Danese ..... 134/1.3

FOREIGN PATENT DOCUMENTS

JP 10-22358 * 1/1998 ..... H01L/21/68

* cited by examiner

*Primary Examiner*—Duy-Vu Deo
(74) *Attorney, Agent, or Firm*—Birch, Stewart, Kolasch & Birch, LLP

(57) ABSTRACT

A wet etching apparatus and method to shorten processing time and to eliminate formation of unintended mask pattern are described. In the conventional art, after a mask pattern is formed, alien substances such as water mist or stain are left on the substrate. The alien substances act as an etching block in the wet etching process. This generates an unintended mask pattern. The present invention uses ultraviolet light to remove the alien substances prior to the etching process. When the alien substances are removed, the intended mask pattern is generated after the etching process. The wet etching device according to the present invention includes an ultraviolet cleaner and a conveyor to convey substrates to and from the ultraviolet cleaner. Spaces for the ultraviolet cleaner and the conveyor are created in the wet etching apparatus by reducing space for cassettes and reducing space required by the loader. As a result, alien substances can be removed without the need for separate sets of equipment, which reduces processing time, simplifies the process, and increases both productivity and reliability.

11 Claims, 4 Drawing Sheets

WET ETCHING APPARATUS AND METHOD

FIELD OF THE INVENTION

This invention relates to a wet etching technique, and more particularly to a wet etching apparatus and method that shortens processing time and prevents generation of an unintended mask pattern for etching.

BACKGROUND OF THE INVENTION

Generally, a liquid crystal display (LCD) is provided with electrode terminals and wires. The terminals and wires include source, gate, and drain electrodes of thin film transistors (TFT's), which are used as switching devices within a liquid crystal cell. The terminals and wires also include data lines for applying a video data signal to each liquid crystal cell, gate lines for applying a scanning signal thereto, and pixel electrodes and common electrodes for coupling an electric field with a liquid crystal layer.

The electrode terminals and wires are made by depositing an electrode material on a substrate and then wet etching the material using a photoresist mask and patterning the same. The wet etching is performed by precipitating a substrate in an etchant or by jetting the etchant onto the substrate by an injection nozzle to react the etchant liquid with the electrode material.

FIG. 1 shows a structure of a conventional wet etching apparatus. The conventional wet etching apparatus includes a plurality of cassettes 20 within a loader 22, a first robot 26, a waiting part 24, an etching part 28, a tilt drain part 30, a de-ionized rinsing part 32, a second robot 36, and a spin drier 34.

The operation of the conventional apparatus is as follows. A substrate, formed with the photoresist mask pattern, is carried from one of the plurality of cassettes 20 into the waiting part 24 by the first robot 26 positioned within the loader 22. The substrate is then sent to the etching part 28 to carry out the etching.

The etching part 28 jets etchant liquid from an injection nozzle onto the substrate to etch the substrate by an etching reaction of an etching layer with the etchant liquid. Afterwards, the substrate is moved to the tilt drain part 30 which inclines the substrate at a desired angle to drain the etchant left on the substrates. Then, any remaining etchant left on the substrates is completely removed by rinsing with de-ionized water by the de-ionized rinsing part 32.

Thereafter, the second robot 36 carries the substrates from the de-ionized rinsing part 32 into the spin drier 34. The spin drier 34 dries the substrates, thus completing the wet etching process.

A process of forming the electrode terminals and the electrode lines on the substrate using the above-mentioned wet etching method is now described. First, the substrate is cleaned and then an electrode material is deposited on the substrate. Next, a mask pattern is formed on the electrode material layer as follows. Initially, a photoresist material is coated to cover the entire electrode material layer. Then the photoresist material is exposed to light to complete the mask pattern. After the mask pattern is formed, the substrate is carried into the wet etching apparatus as shown in FIG. 1 to perform the wet etching process. Thereafter, the mask pattern on the substrate is removed.

In the conventional process, however, an alien substance, such as a water mist or organic film, is often generated around the mask pattern during patterning. In other words, as shown in FIG. 2, an alien substance 42 may be left on the periphery of the mask pattern 40.

The alien substance 42 acts as an etching block interfering in the wet etching process and thus produces an unintended mask pattern as shown in FIG. 3. The shape of a non-etched portion 46 formed with the mask pattern 40 is not identical to the intended mask pattern. As a result, a shape corresponding to the unintended mask pattern remains after the etching process is complete.

In the conventional art, to prevent the generation of the unintended mask pattern, the alien substance 42 is eliminated by adding a cleaning process after formation of the mask pattern 40 and prior to the wet etching process. The alien substance 42 is eliminated by ashing using a separate wet etching apparatus or by cleaning using a separate ultraviolet equipment mounted with a low-pressure mercury lamp.

However, such conventional elimination process to remove alien substances is not performed during the photoresist formation process or the wet etching process, but is a separate process using different equipment. This requires additional resources and time. Further, it requires that the substrate be transported out of one set of equipment to another and then back. As such, productivity and quality are reduced.

SUMMARY OF THE INVENTION

Accordingly, it is an object of the present invention to provide a cleaning apparatus and method that is capable of shortening a process time as well as effectively preventing the formation of unintended patterns during etching work.

Another object of the present invention is to provide a wet etching apparatus and method that is capable of shortening a process time as well as effectively preventing the formation of unintended patterns during etching work.

In order to achieve these and other objects of the invention, a cleaning apparatus according to one aspect of the present invention includes an ultraviolet cleaner a conveyer conveying the substrate to and from the ultraviolet cleaner.

A wet etching apparatus according a second embodiment includes an ultraviolet cleaner cleaning the alien substances from the substrate, a conveyer conveying the substrate to and from the ultraviolet cleaner, a loader loading the substrate to and from the ultraviolet cleaner, and an etching unit etching the substrate that is free of the alien substances, the conveyer conveying the substrate from the ultraviolet cleaner into the etching unit.

A cleaning method according to a further aspect of the present invention includes the steps of forming the photoresist mask pattern on the substrate, conveying the substrate to a clean device, exposing the substrate to an ultraviolet light to remove the alien substances, and conveying the substrate from the cleaning device to an etching station.

A wet etching method according to a still further aspect of the present invention includes the steps of cleaning a substrate having an alien substances from an ultraviolet cleaner, conveying the substrate to and from the ultraviolet cleaner, loading the substrate to a loader, and etching the substrate in an etching unit.

Advantages of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
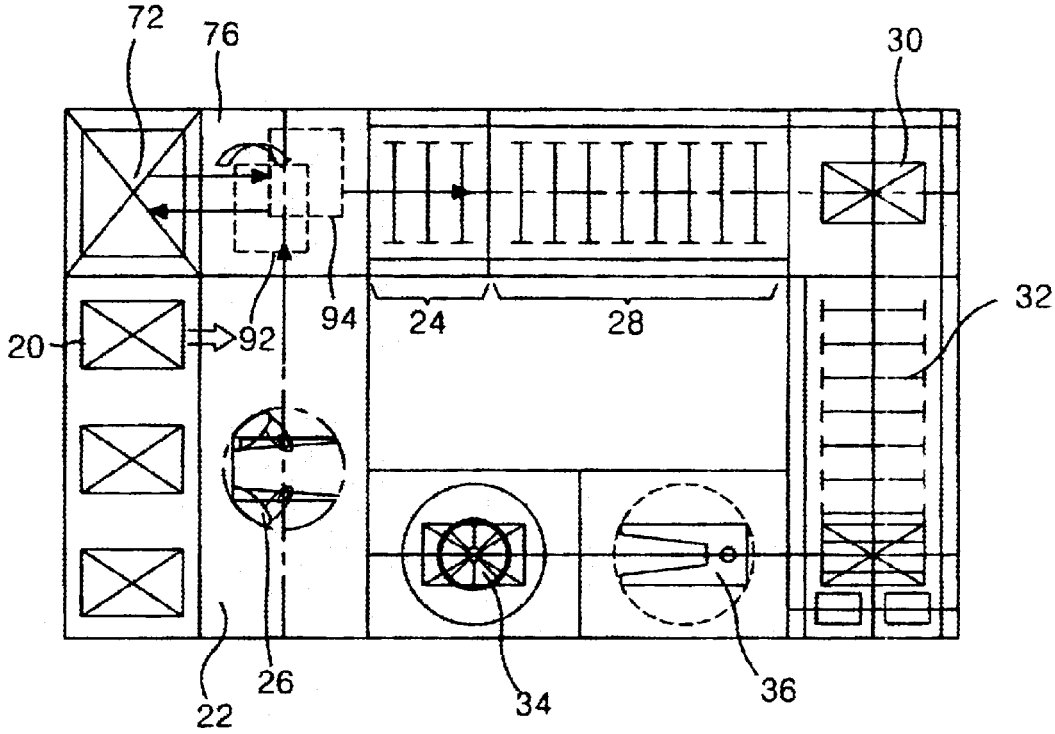
FIG. 4 is a plan view showing a structure of a wet etching apparatus according to an embodiment of the present invention.

A wet etching apparatus according to an embodiment of the present invention is shown in FIG. 4. In this wet etching apparatus, an eximer ultraviolet cleaner is mounted within the wet etching apparatus. More specifically, the number of cassettes loaded at the loader is reduced by one from the conventional wet etching apparatus to provide the necessary space to mount the eximer ultraviolet cleaner. The alien substance, such as an organic film or a water mist, left on the substrate is eliminated by the eximer ultraviolet cleaner just before the wet etching takes place.

Figure 1:
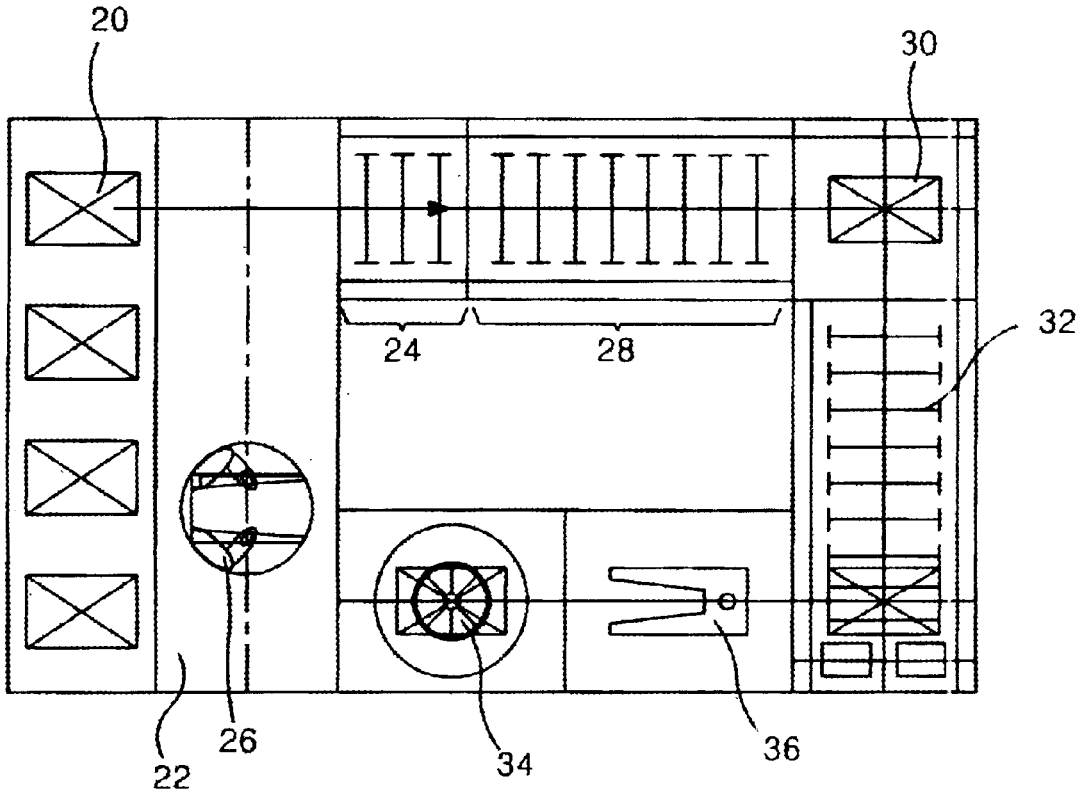
FIG. 1 CONVENTIONAL ART
FIG. 1 is a plan view showing a structure of a conventional wet etching apparatus.
Figure 2:
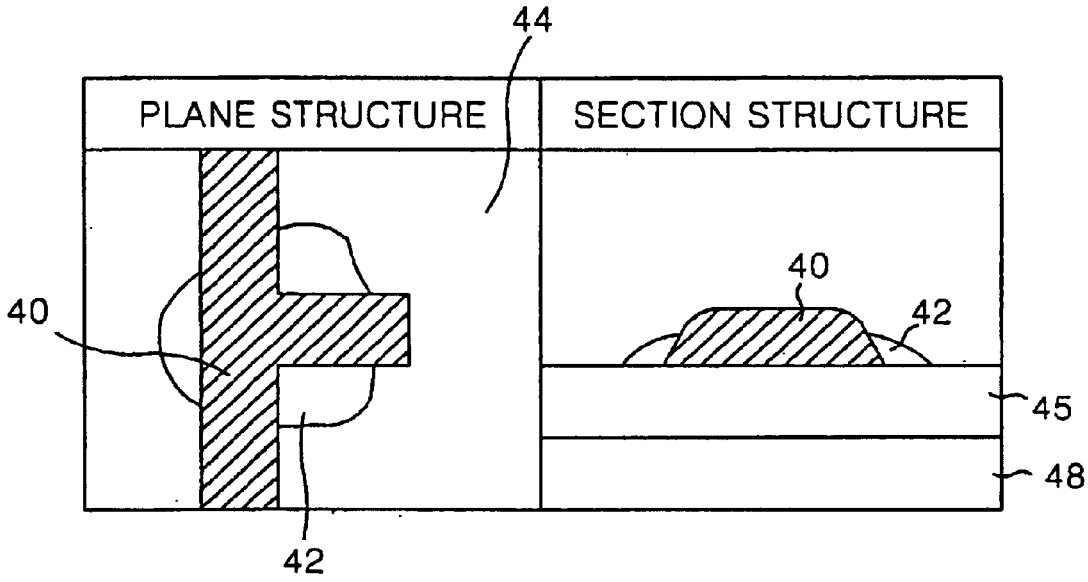
FIG.2 CONVENTIONAL ART
FIG. 2 represents a plane structure and a sectional structure of a substrate with a mask pattern.
Figure 3:
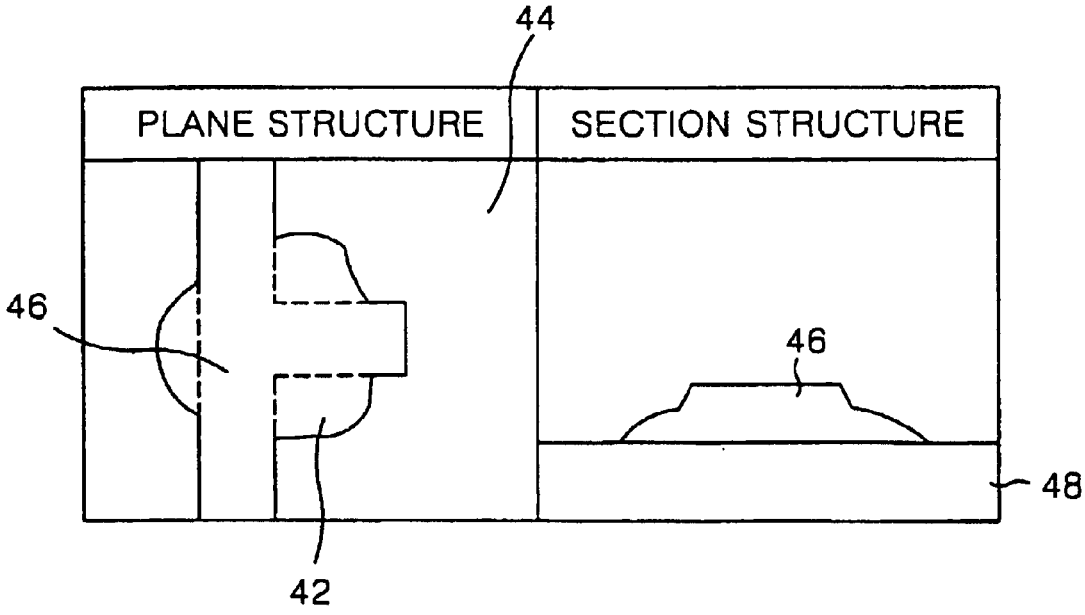
FIG.3 CONVENTIONAL ART
FIG. 3 represents a plane structure and a sectional structure of the pattern after etching the substrate shown in FIG. 2.

Referring to FIG. 4, in addition to the elements of the conventional apparatus shown in FIG. 1, the present wet etching apparatus further includes an eximer ultraviolet cleaner 72 and a conveyer 76. In other words, the cleaner 72 and the conveyor 76 are integrated into the wet etching apparatus. A space for the eximer ultraviolet cleaner 72 is created by reducing the number of cassettes, e.g., by at least one, and an amount of space taken up by the conveyor is created by reducing the space of the loader 22. The conveyor 76 transfers the substrate between the eximer ultraviolet cleaner 72 and the waiting part 24.

The process of forming the photoresist mask pattern on the substrate prior to the wet etching work is similar to the conventional art. First, the substrate is cleaned. Then, an electrode material is deposited on the substrate. Next, a photoresist mask pattern is formed on the electrode material layer.

The process of forming the mask pattern, according to the embodiment of the present invention, is as follows. Initially, the photoresist material is coated to cover the entire electrode material layer. Then the photoresist is exposed to light and patterned to complete the mask pattern.

Figure 5A:
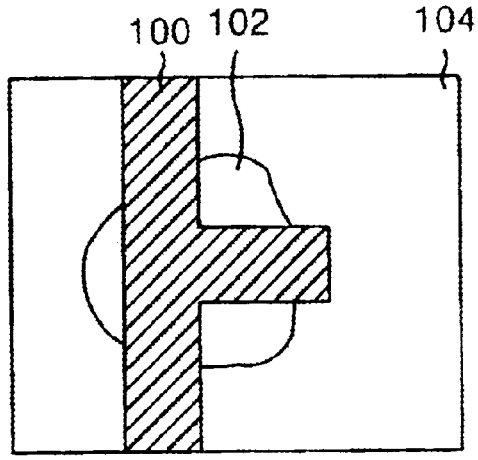
FIG. 5A and FIG. 5B are plan views showing substrate shapes prior to and after cleaning of the substrate using the eximer ultraviolet cleaner of the wet etching apparatus of FIG. 4.

A plan view of the substrate in which the photoresist mask pattern is formed by the above-mentioned work is as shown in FIG. 5A. As seen, an alien substance 102, such as water mist or a stain, may be left around a mask pattern 100. The substrate, with the mask pattern 100, is arranged in sheets with other substrates in a cassette 20. The sheets may be arranged in groups of ten and each cassette 20 may contain one such group of sheets. Each substrate, arranged within a cassette 20, is loaded in sequence with other substrates onto the conveyer 76 by the first robot 26 within the loader 22.

The conveyer 76 includes of an upper conveyer 92 and a lower conveyer 94. First, the substrate is loaded onto the upper conveyer 92 by the first robot 80. The substrate loaded on the upper conveyer 92 is conveyed into the eximer ultraviolet cleaner 72, such as by a rolling operation.

The eximer ultraviolet cleaner 72 includes an eximer ultraviolet lamp. An ultraviolet ray is irradiated from the ultraviolet lamp onto the substrate. When the ultraviolet ray is irradiated, the alien substance 102 left around the mask pattern 100 as shown in FIG. 5A reacts due to the ultraviolet light and generates ozone gas $O_3$. This eliminates the alien substance 102.

Figure 5B:
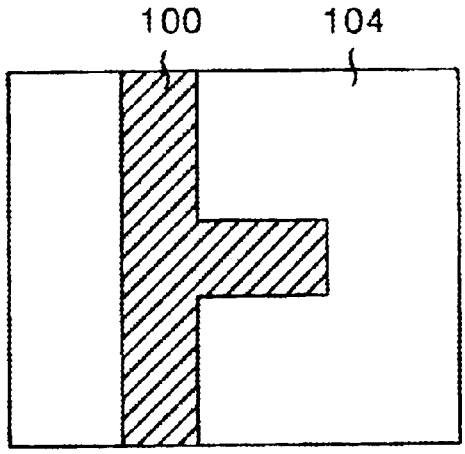

FIG. 5B shows a plan view of the substrate after the alien substance 102 is eliminated. As seen, alien substance 102 left around the mask pattern 100 is removed and leaves the intended mask pattern 100 on the substrate.

Then the substrate, free from alien substances, is conveyed from the eximer ultraviolet cleaner 72 on to the lower conveyer 94, and then is conveyed to the waiting part 24. Note that the lower conveyer may need to rotate 90° before conveying the substrate to the waiting part 24 depending on the construction.

Then the substrate, positioned at the waiting part 24, is sent to the etching part 28 to carry out the etching process. The etching part 28 jets etchant from an injection nozzle onto the mashed substrate to etch exposed portions of the substrate. Afterwards, the tilt drain part 30 inclines the substrate at a desired angle to drain the etchant left on the substrates. Then, any remaining etchant left on the substrates is completely removed by rinsing with de-ionized water by the de-ionized rinsing part 32.

Thereafter, the second robot 36 carries the substrates from the de-ionized rinsing part 32 into the spin drier 34. The spin drier 34 dries the substrates, thus completing the wet etching process.

In the present wet etching apparatus and method, the alien substance 102, which acts as an etching block, is eliminated with the eximer ultraviolet cleaner 72. Thus the unintended mask pattern is not produced during the etching process. This is done without the need for any separate equipment. Thus, processing is shortened and simplified, and the productivity and reliability are increased.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A cleaning apparatus to clean alien substance from a substrate provided with a mask pattern the apparatus comprising:

an ultraviolet cleaner for cleaning the alien substance remaining on the substrate after developing the mask pattern; and a conveyer for in-line conveying the substrate to and from the ultraviolet cleaner for wet etching;

wherein the ultraviolet cleaner is installed at a predetermined area in a loader on which a plurality of cassettes arranged with the substrate are loaded.

2. The apparatus according to claim 1, wherein the conveyer includes:

a first conveyer conveying the substrate from the loader to the ultraviolet cleaner; and a second conveyer conveying the substrate from the ultraviolet cleaner to a wet etching unit.

3. The apparatus according to claim 1, wherein the ultraviolet cleaner uses eximer ultraviolet light.

4. The apparatus according to claim 1, wherein the substrate includes at least one of a gate electrode, a source electrode, a drain electrode, a pixel electrode, and a protective layer.

5. The apparatus according to claim 1, wherein the substrate includes at least one of a black matrix and a common electrode.

6. A wet etching apparatus to clean alien substances from a substrate with a mask pattern prior to wet etching, the apparatus comprising:

an ultraviolet cleaner cleaning the alien substances from the substrate after developing the mask pattern;

a conveyer conveying the substrate to and from the ultraviolet cleaner;

a loader loading the substrate to and from the ultraviolet cleaner, the ultraviolet cleaner being installed at a predetermined area in the loader on which a plurality of cassettes arranged with the substrate are loaded; and an etching unit etching the substrate that is free of the alien substances, the conveyer conveying the substrate from the ultraviolet cleaner into the etching unit.

7. The apparatus according to claim 6, wherein the conveyer includes:

a first conveyer conveying the substrate from the loader to the ultraviolet cleaner; and a second conveyer conveying the substrate from the ultraviolet cleaner to the etching unit.

8. The apparatus according to claim 6, wherein the conveyer is installed at a predetermined area between the ultraviolet cleaner and the etching unit in the loader.

9. The apparatus according to claim 6, wherein the substrate includes at least one of a gate electrode, a source electrode, a drain electrode, a pixel electrode, and a protective layer.

10. The apparatus according to claim 6, wherein the substrate includes at least one of a black matrix and a common electrode.

11. The apparatus according to claim 6, further comprising:

a tilt drain part flowing an etchant on the substrate;

a de-ionized rinse part eliminating the etchant on the substrate; and a spin drier drying a de-ionized water.

* * * * *